United States Patent [19]

Huang

[11] Patent Number: 5,063,671

[45] Date of Patent: Nov. 12, 1991

[54] KITCHEN SHEARS WITH HIDING SPRING

[76] Inventor: Johnny Huang, 7F-1, No. 101, Sec. 2, Ho-Ping, Taipei, Taiwan

[21] Appl. No.: 648,652

[22] Filed: Jan. 31, 1991

[51] Int. Cl.[5] ..... B26B 13/00

[52] U.S. Cl. ..... 30/262; 30/254

[58] Field of Search ..... 30/261, 262, 159, 254, 30/234–236; 81/321, 322

[56] References Cited

U.S. PATENT DOCUMENTS

| | | | |
|---|---|---|---|
| 663,565 | 12/1900 | Fisher | 30/261 |
| 2,392,118 | 1/1946 | Calarillo | 30/261 |
| 3,834,022 | 9/1974 | Students | 30/261 |
| 4,203,208 | 5/1980 | Tausendfreundt et al. | 30/261 X |

FOREIGN PATENT DOCUMENTS

| | | | |
|---|---|---|---|
| 3721261 | 2/1988 | Fed. Rep. of Germany | 30/232 |

*Primary Examiner*—Douglas D. Watts

*Attorney, Agent, or Firm*—Bucknam and Archer

[57] ABSTRACT

A pair of kitchen shears with hiding spring, comprised of two parts pivoted together to form into two handles and two cutting blades. The two cutting blades have each a recess at one side facing against each other defining therein a receiving space for holding a torsion spring which is secured in position by a pivot to increase shearing force. Walnut crusher or small device for added function may be made on the two handles.

2 Claims, 2 Drawing Sheets

KITCHEN SHEARS WITH HIDING SPRING

BACKGROUND OF THE INVENTION

The present invention relates to spring action shears, and more particularly relates to such a pair of spring action shears in which the spring is protected from exposing to the air.

Various types of shears have been developed for cutting metal, etc. by the scissors action of two opposed cutting edges. In recent years, because of fast development in material science, metal, high polymer material or even ceramic have been used for making shears. Recently, there is a kind of spring action shears provided for cutting purpose which requires less labor in operation. In the structure of this kind of spring action shears, a spring means is connected between the two handles of each pair of shears so that the two opposed cutting edges thereof can be automatically pushed to an open status for next cutting process after each cut. This structure can also increase shearing force during operation, however, it requires much force to surpass the elastic force of the spring means. Because the spring means is connected between the two handles, much space is occupied. During operation, the fingers may be hurt by the spring means easily. Further, the spring means may become covered with rust easily to cause elastic fatigue problem because it is exposed outside.

The present invention has been accomplished to eliminate the aforesaid problems. It is therefore an object of the present invention to provide a pair of spring action shears in which the spring means is hidden from being exposed to the air so that much space can be utilized for incorporating a small device to the two handles thereof, and longer service life of the spring means can be ensured.

BRIEF DESCRIPTION OF THE DRAWINGS

The present invention will now be described by way of example with reference to the annexed drawings, in which.

DETAILED DESCRIPTION OF THE PREFERRED EMBODIMENT

Figure 1:
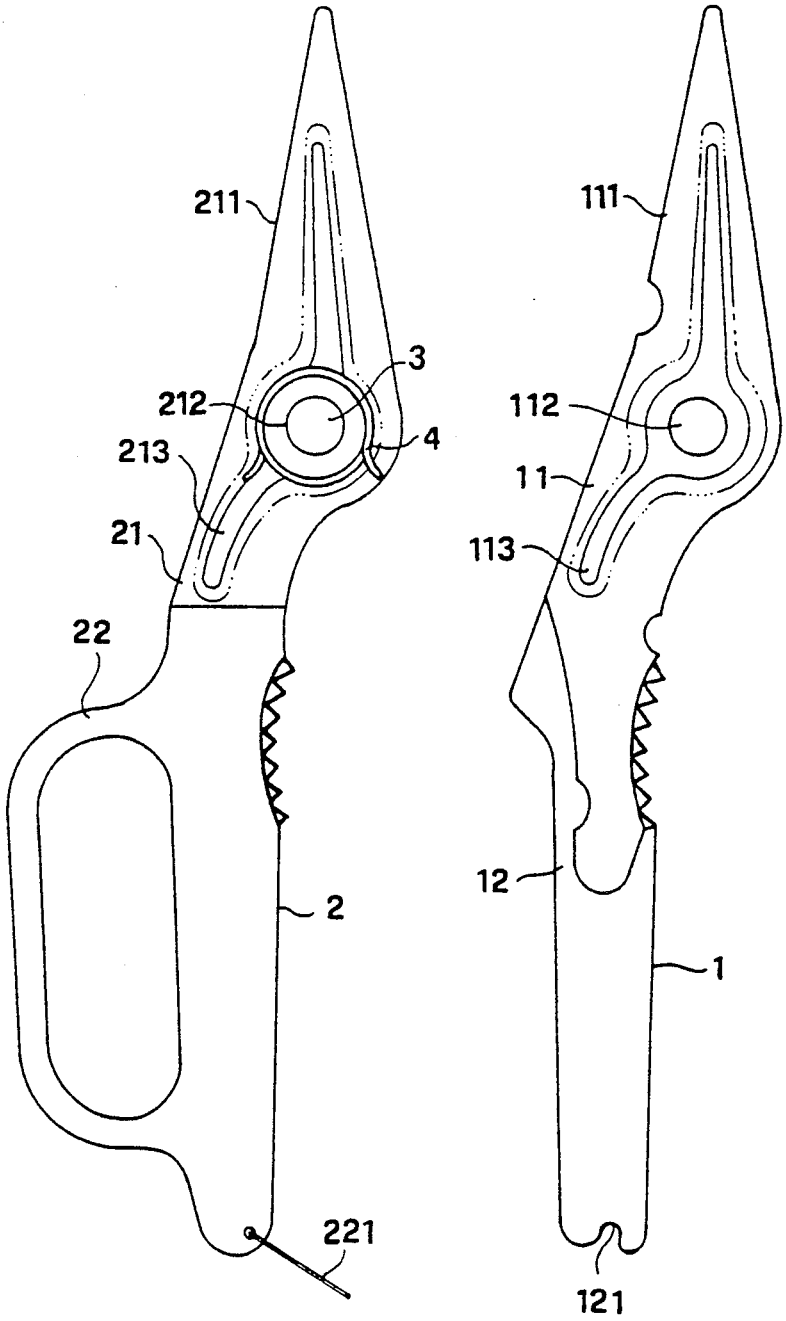
FIG. 1 is a perspective dismantled view of the preferred embodiment of the kitchen shears with hiding spring of the present invention.

Turning now to the annexed drawings in greater detail, therein illustrated is a pair of kitchen shears with hiding spring embodying the present invention which are generally comprised of two parts 1 and 2 pivotably connected together by a pivot 3 with a torsion spring 4 set in therebetween. The first and second parts 1 and 2 are pivoted together to form into two cutting blades 11 and 21 and two handles 12 and 22. The cutting blades 11 and 21 which are each terminating in a sharp point have each a cutting edge 111 or 211 disposed against each other for cutting, a hole 112 or 212 at the center for mounting the pivot 3, and a recess 113 or 213 at the middle. The recess 113 or 213 comprises a circular portion at the middle in which the hole 112 or 212 is made, and two elongated portions obliquely extending from said circular portion at two opposite ends. The recess 113 or 213 is made through punching process so that a raised portion is formed in the back side of the cutting blade 11 or 21. When the two cutting blades 11 and 21 are connected together, a space is defined within the recesses 113 and 213 for holding the torsion spring 4.

Referring to the annexed drawings again, the handles 12 and 22 which are orthopedically engineered for comfortable grip are relatively thicker than the cutting blades 11 and 21 so that the cutting blades 11 and 21 can be firmly retained by the handles 12 and 22. The handles 12 and 22 may be variously embodied to provide added functions. In the present preferred embodiment, the first handle 12 is designed in a straight bar while the second handle 22 has an opening for convenient holding of the fingers. The known walnut crusher may be incorporated in the handles 12 and 22. Further, the first and second handles 21 and 22 may have a retaining notch 121 and a retainer loop 221 so that the two parts 1 and 2 can be firmly secured together by binding the retainer loop 221 on the retaining notch 121 when the scissors is not in use. The torsion spring 4 is designed in shape and size fitting the recesses 113 and 213, defining therein a center hole slightly larger than the hole 112 or 212 so that the pivot 3 can be conveniently fastened therein to firmly retain the torsion spring 4 in the space defined within the recesses 113 and 213.

Figure 2:
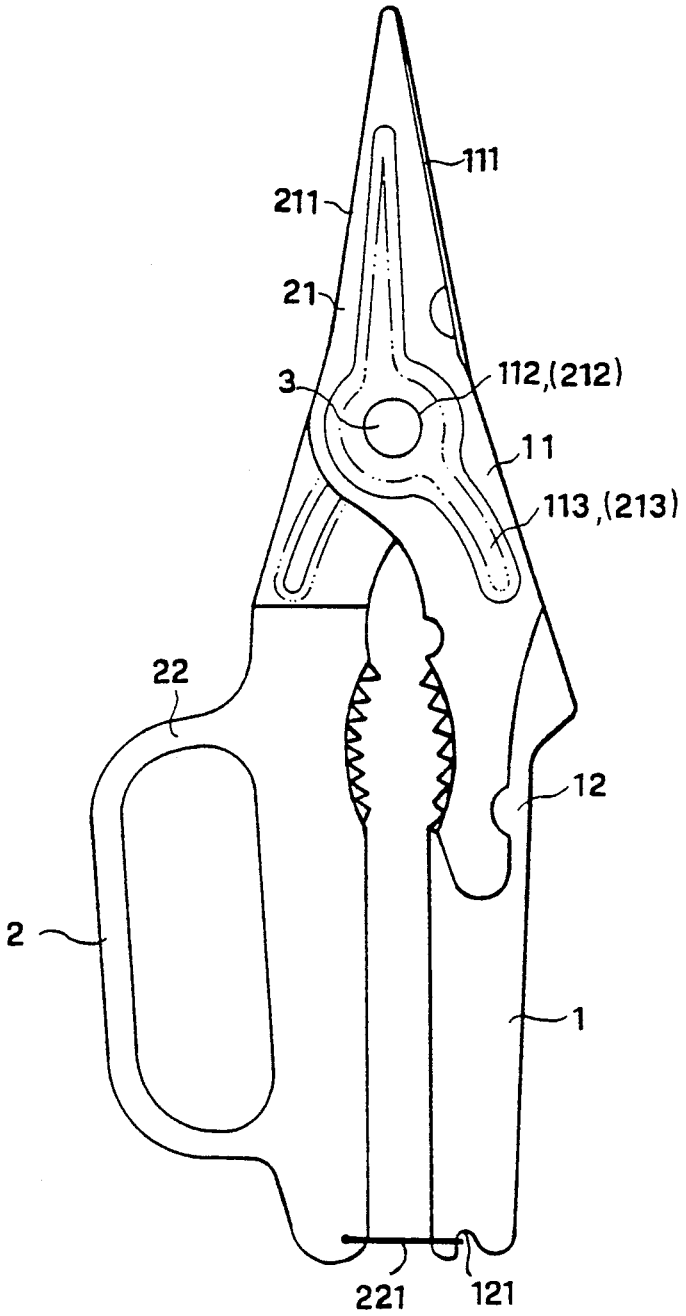
FIG. 2 is a perspective assembly view thereof.

The pivot 3 is an I-shaped rivet fastened in the holes 112 and 212 of the cutting blades 11 and 21 and the hole defined within the torsion spring 4. After fastening in the two parts 1 and 2, the head of the pivot 3 fits flush with the surface of the cutting blades 11 and 21. After the two parts 1 and 2 are connected together to form into a scissors, it is presented in configuration as shown in FIG. 2.

As described in the foregoing statement, the present invention is to provide a pair of kitchen shears with hiding spring in which the spring is protected from exposing to the air so that the service life of the scissors can be greatly extended and better safety can be ensured during operation.

It is apparent that various modifications could be made to the present invention without departing from the basic teachings thereof. Recognizing that various modifications are apparent, the scope herein shall be deemed as defined in the claims set forth hereinafter.

I claim:

1. A pair of kitchen shears with hiding spring, comprising two parts pivoted together to form two handles and two cutting blades, said two handles having one a retainer loop and the other a retaining notch for holding said retainer loop permitting said two parts to be closely retained together, said two cutting blades having each a pivot hole at the center for fastening a pivot to pivotably secure said two parts together, and characterized in that said two cutting blades have each a recess facing against each other for holding a torsion spring, said recess comprising a circular portion at the middle in which said pivot hole is made, and two elongated portions obliquely extending therefrom at two opposite ends, said torsion spring being firmly retained in said recess by said pivot.

2. The kitchen shears with hiding spring of claim 1, wherein said two cutting blades have each a raised portion formed at one side through punching process.

* * * * *